United States Patent [19]

Lindsey et al.

[11] Patent Number: 4,669,610

[45] Date of Patent: Jun. 2, 1987

[54] PACKAGE ASSEMBLY

[75] Inventors: Frank Lindsey, Stratford, Conn.; Charles Walkley, East Brunswick, N.J.

[73] Assignee: Conair Corporation, Edison, N.J.

[21] Appl. No.: 818,325

[22] Filed: Jan. 13, 1986

[51] Int. Cl.[4] ..... B65D 85/00

[52] U.S. Cl. ..... 206/320; 206/461; 206/459; 206/471; 206/45.18; 206/45.24

[58] Field of Search ..... 206/806, 470, 459, 461, 206/320, 471, 45.18, 45.24, 45.33

[56] References Cited

U.S. PATENT DOCUMENTS

| | | | |
|---|---|---|---|
| D. 219,429 | 12/1970 | Poppleton . | |
| D. 238,674 | 2/1976 | Luedtice . | |
| D. 244,775 | 6/1977 | Wilson . | |
| D. 252,797 | 9/1979 | Fuller . | |
| D. 267,394 | 12/1982 | Liptak et al. . | |
| D. 273,565 | 4/1984 | Driskell et al. | 206/461 |
| D. 275,835 | 10/1984 | Borst . | |
| 3,025,958 | 3/1962 | Snape | 206/806 |
| 3,192,681 | 7/1965 | Greenbaum . | |
| 3,375,921 | 4/1968 | Ligon | 206/462 |
| 3,463,309 | 8/1969 | Szostek | 206/470 |
| 3,497,059 | 2/1970 | Watts, Jr. . | |
| 3,685,649 | 8/1972 | Diehl . | |
| 3,927,762 | 12/1975 | Zdarsky et al. . | |
| 4,091,927 | 5/1978 | Lunsford | 206/467 |
| 4,213,531 | 7/1980 | Rae | 206/463 |
| 4,261,462 | 4/1981 | Wysocki . | |
| 4,356,919 | 11/1982 | Matney | 206/806 |
| 4,456,124 | 6/1984 | Kay et al. | 206/470 |
| 4,466,534 | 8/1984 | Dunn | 206/462 |
| 4,499,353 | 2/1985 | Shields | 206/470 |
| 4,512,474 | 4/1985 | Harding | 206/461 |

*Primary Examiner*—Joseph Man-Fu Moy
*Attorney, Agent, or Firm*—Louis Weinstein

[57] ABSTRACT

A package for personal hair care products and the like comprising package halves each formed of a transparent plastic material and having pockets integrally joined to and projecting from the planar portions of the transparent package halves which, when the transparent package halves are assembled, cooperatively form regions enclosing the product. One of the pair of package halves further includes a second pocket integrally joined to and projecting from the planar portion of the last mentioned package half for storing a power cord, as well as an instruction sheet and/or other printed matter. Both package halves are further provided with channel-shaped recesses projecting from and integrally joined to the planar portions of their respected package halves, said channel-shaped portions cooperatively forming a passageway extending between the pockets housing said product and the storage pocket, said passageway containing that portion of the power cord extending between the product and the cord storage pocket. A planar sheet is arranged between the container sections of the package halves and is preferably opaque. Portions of the planar sheets are cut away in the region of the pockets and passageway. The sheet is preferably provided with printed matter relating to the product and its source.

19 Claims, 5 Drawing Figures

PACKAGE ASSEMBLY

FIELD OF THE INVENTION

The present invention relates to packages for containing and displaying a product and more particularly to a novel transparent package for displaying electrical personal care products and the like in which the product and advertising matter are contained within the package comprised of transparent package halves.

BACKGROUND OF THE INVENTION

Packages for containing and displaying products, typically referred to as blister packs, are conventionally comprised of either one or two plastic members, each containing a "bubble" or "blister" which houses the product and which singular or plural plastic sheets are held together either by being joined to a cardboard sheet, in the example of a single clear plastic member or having integral flanges arranged between a pair of sheets, typically cardboard sheets, which are joined together and which form a frame about the plastic members. The cardboard members comprise a display card containing art work, illustrations of use, trademarks, price information, and the like. The display card is typically provided with a slot or hole to facilitate its suspension upon the projection of a display rack. Some of blister-type display packages have also incorporated display cards incorporated within the blister containing the product. To date, there are no packages which are totally transparent and which eliminate the need for a display card to join the package halves together and which, while providing a display sheet, do not interfere with the display of the product or otherwise cover the product contained within the package.

BRIEF DESCRIPTION OF THE INVENTION

The present invention is characterized by comprising a novel blister-type display package formed of package halves of a transparent plastic material. Each of the package halves includes a first pocket integrally joined to and projecting from a planar surface portion of the package half. The aforesaid pockets in the package halves cooperatively form a hollow region for enclosing the product which may, for example, be an electrical personal care product having a power cord as an integral part thereof.

At least one of the package halves is further provided with a cord containing pocket integral with and projecting from the planar portion of said the last-mentioned package half for containing the power cord, as well as instruction sheets and the like. The cord containing pocket is formed at the lower end of the package and is provided with one surface having integral supporting projections which cooperate with an adjacent side of the package to support the package upright upon a horizontal surface for display purposes.

Each of the package halves are further provided with a channel-shaped recess projecting from and integral with the planar portions of their respective package halves and cooperatively forming a power cord passageway extending between the product receiving pockets and the cord containing pocket.

A display sheet is provided within the package and is sandwiched between the planar portions of the package halves. The sheet is provided with cut away portions which conform to the product receiving pockets and the power cord passageway to provide unimpeded viewing of the product and the power cord portion contained within the aforesaid passageway. The display sheet contains printed matter typically relating to the product and its source. The sheet covers the open end of the cord containing pocket thus rendering the cord containing pocket visible from only one side of the package, hereinafter referred to as the rear side of the package. Both the product and the display sheet, as well as any instruction and/or advertising sheets are fully contained within the transparent package halves which are securely joined together along a pair of integral cooperating flanges provided about the periphery of each package half. The package halves are provided with an opening near the top thereof permitting display of the package by suspension upon a projecting member provided as part of a display stand. Thus, the package may be displayed in a self supporting manner upon a horizontal surface or alternatively by suspension upon a display stand.

OBJECTS OF THE INVENTION AND BRIEF DESCRIPTION OF THE FIGURES

It is therefore one object of the present invention to provide a novel display package comprised of a pair of transparent package halves having pockets for cooperatively supporting and displaying the product contained within the cooperating pockets, said package halves being securely joined to one another.

Another object of the present invention is to provide a novel package for storing and displaying a product and incorporating a sheet contained between the package halves and having printed matter relating to the product and its source and being provided with cut outs arranged in the regions where the product is contained to provide an unobstructed view of the product while nevertheless providing aesthetically appealing package further including helpful information relating to the product.

Still another object of the present invention is to provide a novel display package for electric personal care products and the like and having at least one product containing pocket which serves the additional function of rendering the package self supporting in an upright fashion thereby enabling the package to be alternatively displayed either in an upright manner upon a display surface or by suspension from a projection provided upon a display stand.

The above as well as other objects of the present invention will become apparent when the reading the accompanying description and drawings, in which.

DETAILED DESCRIPTION OF THE INVENTION

Figure 1:
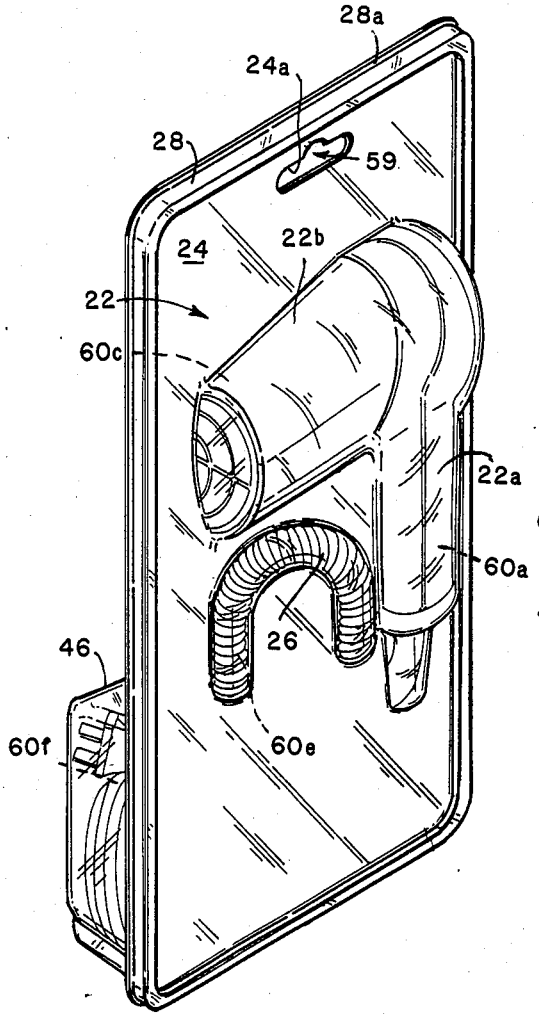
FIG. 1 shows a perspective view of a package design in accordance with the principles of the present invention.
Figure 2:
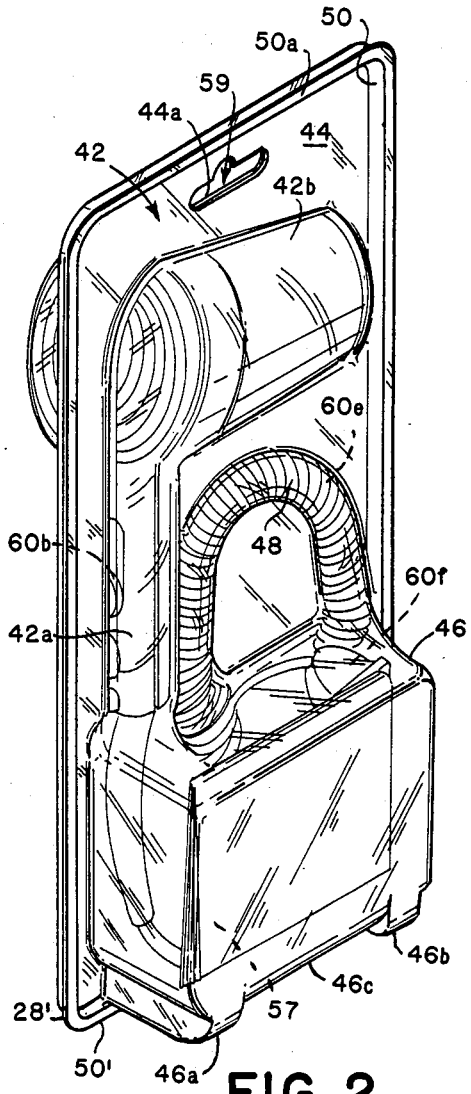
FIG. 2 shows a perspective rear view of the package of FIG. 1.
Figure 3:
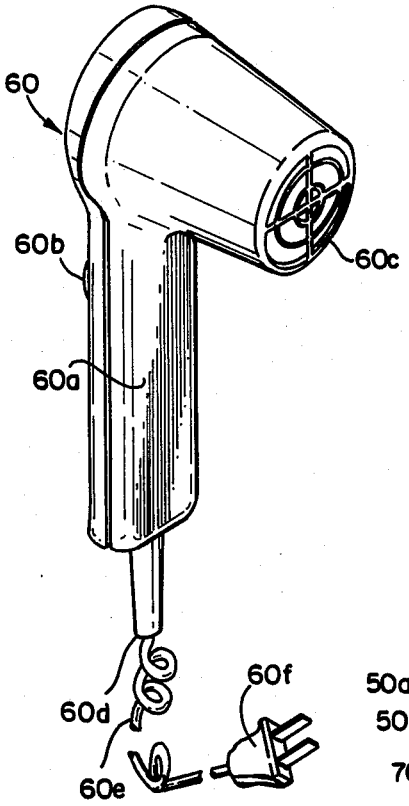
FIG. 3 is a perspective view of the product housed within the package of FIG. 1.
Figure 5:
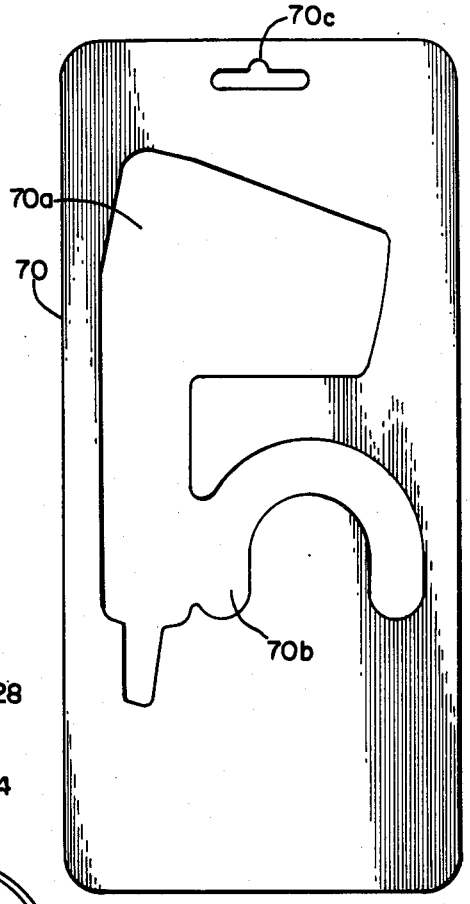
FIG. 5 is a plan view of the display sheet employed in the package of FIG. 1.

Making reference to all of the figures, there is shown therein a package 10 designed in accordance with the principles of the present invention and which is comprised of first and second transparent package halves 20 and 40 each formed of a transparent, relatively rigid plastic material such as polyvinylchloride (PVC). Each of the package halves 20 and 40 is produced using any one of the procedures including injection molding, molding, vacuum forming, and the like.

Package halves 20 and 40 are each provided with a product receiving pocket 22,42 being respectively integral with and projecting from a planar surface portion 24, 44. Each of the product receiving pockets has a substantially C-shaped cross-section. Each product receiving pocket, such as, for example, pocket 22, is L-shaped, having a vertically aligned portion 22*a* and a horizontally aligned portion 22*b*. Pockets 22 and 42 are coaligned when the package halves 20 and 40 are assembled to provide a product receiving region 55 for receiving the product which may, for example, be an electrical personal care product such as a hair dryer 60 having a handle portion 60*a* provided with a control 60*b* and housing a motor (not shown) and a heating unit (not shown) for emitting heated air from outlet 60*c*. A power cord 60*d*, which is provided with a resilient extendable helical portion 60*e* is provided at its free end 60*f* with a plug 61 for insertion into a conventional electrical socket (not shown).

Package half 40 is further provided with a power cord receiving pocket 46 integral with and projecting from the planar surface portion 44 of package half 40. Pocket 46 has a substantially parallelipiped configuration, defining a hollow region for receiving the major portion of the power cord described hereinabove, said hollow region 48 being defined by pocket 46 and the planar surface portion 24 of package half 20 which overlies the open end of pocket 46 and which is substantially parallel to planar surface portion 44 of package half 40.

Package halves 20 and 40 are further provided with substantially C-shaped channels 26, 48 which cooperatively form an elongated passageway extending between and communicating with the lower end of pocket portions 22*a*, 42*a* and the upper end of pocket 46. The helical portion 60*e* of the power cord extends through passageway 26 with the remaining portion of the power cord and plug 61 being contained within the cord receiving pocket region 48. Pocket 46 may also be provided with folded sheets 57 which may contain instructions for use and/or maintenance of the product 60.

Figure 4:
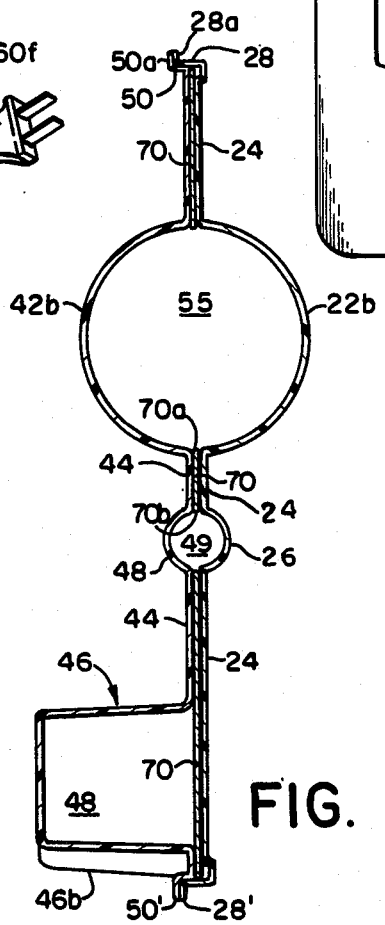
FIG. 4 is a sectional view of the package of FIG. 1.

Package halves 20 and 40 further include integral flanges 28, 50, which flanges are continuous about the substantially rectangular-shaped perimeter of each package half, said flanges extending substantially at right angles relative to their planar portions 24,44. The free ends of the flanges extend outwardly transverse to inward portions and engage one another in the manner shown best in FIG. 4 so that flange 28 is external to and encircles flange 50 and free ends 28*a* and 50*a* are in engagement. Flanges 28 and 50 are joined preferably by either a radio frequency or an ultrasonic technique to secure package halves 20 and 40 together although the flanges may be joined by heat, adhesive bonding or the like. Although flange 28 is shown as being external to flange 50, it should be understood that the flanges may be oriented in the opposite direction, i.e. so that the flanges 28 and 50 extend toward the right relative to FIG. 4 and so that flange 50 is external to and encircles flange 28.

A flat display sheet 70 is contained within the package 10 and is arranged between package halves 20 and 40. Sheet 70 is substantially parallel to and is engaged by the planar portion 24 and 44 of package halves 20 and 40 respectively. Sheet 70 preferably has a rectangular-shape conforming to the shape of package 10. The sides of sheet 70 extend to the flanges 28, 50 and is provided with a first cut-out portion 70*a* coaligned with pockets 22,42 and a second cut out portion 70*b* coaligned with channels 26,48 so that regions 55 and 49 are totally devoid of sheet 70, thereby providing adequate room within regions 55 and 49 for respectively receiving the body portion 60*a* and power cord 60*d*–60*e* and further providing an unobstructed view of the product from both the front and the rear sides of package 10. The lower portion of sheet 70 covers the open end of the pocket 46 and substantially fully covers and conceals the cord receiving pocket 46 when viewing package 10 from the front thereof, while providing a substantially unobstructed view of the contents of pocket 46 when viewing the package from either the left-or right-hand sides or the rear thereof.

Pocket 46 is provided with a pair of recesses 46*a* and 46*b* integral with and projecting downwardly from surface 46*c* of pocket 46, which surface 46*c* is adjacent to the flanges 28′, 50′ arranged along the lower end of package 10, the outer surfaces of recesses 46*a*,46*b* and the flanges 28′, 50′ provided at the lower end of package 10, cooperating to support package 10 in a substantially vertical orientation upon a horizontal supporting surface for display purposes. The upper ends of package halves 20 and 40 are each provided with openings 24*a* and 44*a*, provided near the upper ends of the package halves and which are coaligned to form an opening 59 for receiving a slender projecting member (not shown) forming part of a display stand thus providing the alternative of displaying package 10 either upon a supporting surface or suspended from a display stand.

Sheet 70 is also provided with an opening 70*c* coaligned with openings 24*a*, 44*a* to facilitate insertion of a display stand projection through opening 59. Sheet 70 is further provided with printed matter typically relating to the product display therein and the source of said product. Either or both sides of sheet 70 may be utilized for this purpose. Sheet 70 may further be provided with graphic matter for enhancing the aesthetic appearance of the package 10. The passageway 49 preferably has a pleasing shape such as the U-shaped configuration shown in FIG. 1 which further contributes to the aesthetic appearance of the package as well as providing an unobstructed view of the package contents. The depth of pocket 46 is substantially greater than the depth of pocket 42, enabling the completed packages to be stored in back to back fashion.

Although the preferred embodiment shows the product as being a hair dryer, it should be understood that other products, both electrical and non-electrical may be displayed in a like fashion, although the package is ideally suited for storage and display of electrical products such as personal care products, including hair dryers, electric curling irons, lighted mirrors, and the like.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A combination product and package for the product such as an appliance or the like comprising:

said product having a predetermined shape and an electrical cord coupled to the product;

first and second transparent package halves each having a product receiving pocket substantially conforming to the shape of the product and integral with and projecting from the plane of the remainder of the package half;

said product being contained in said pocket;

said package halves, when joined, having their planar portions substantially parallel and adjacent to one another, said pockets of each package half extending away from one another and being aligned to cooperatively form a hollow enclosure pocket substantially conforming to the shape of the product to be received therein;

a display sheet being positioned between adjacent planar faces of the said package halves and having a cut-out portion whose perimeter at least partially surrounds the product enclosed therein;

said display sheet being completely contained within said package;

means for joining the package halves about the perimeter thereof;

said display sheet being provided with decorative graphics to enhance the aesthetics of the package and identify the product and/or its source; both said card and said product being visible through said package halves;

one of the package halves having a cord containing pocket integrally joined to and projecting from the planar portion of the associated package half for receiving at least a portion of said electrical cord;

the other one of the package halves having a planar portion thereof substantially covering said cord containing pocket;

the major portion of said electrical cord being contained in said cord containing pocket;

said cord containing pocket having one supporting surface adjacent to one end of said package and cooperating with said one end of said package for stably maintaining the package upright when said one end and said one supporting surface rest upon a horizontal surface.

2. The package of claim 1 wherein the edge of each combined product and package half is provided with an integral flange surrounding the entire perimeter of the package half and is aligned transverse to the planar portion of the package half;

the free ends of the integral flanges engaging one another when said package halves are assembled together; and said flanges being joined together thereby sealing the packages.

3. The combined product and package of claim 4 wherein said flanges are bonded together.

4. The combined product and package of claim 4 wherein said flanges are adhesively bonded together.

5. The combined product and package of claim 4 wherein said flanges are joined together by the application of heat (radio frequency ultrasonics etc.).

6. The combined product and package of claim 1 wherein the package half having the cord receiving pocket is further provided with an elongated channel-shaped recess integrally joined to and projecting from said planar portion and extending between said product and cord containing pockets for receiving a portion of the cord extending from the product;

the remaining package half having a similar shaped elongated recess extending from and integrally joined to the planar portion of the package half;

said recesses being coaligned when the package halves are joined together to form a passageway of annular cross-section for enclosing said cord portion.

7. The combined product and package of claim 6 wherein said display sheet is provided with a slot having shape conforming to and being aligned with said passageway to provide an unobstructed view of the cord in the cord receiving passageway.

8. The combined product and package of claim 7 wherein a portion of said sheet covers the cord receiving pocket rests against the planar portion of the package half covering the cord receiving pocket.

9. The combined product and package of claim 1 wherein said supporting surface of said cord containing product is provided with a pair of recesses joined to and extending outwardly from said supporting surface and defining a pair of supporting surfaces cooperating with the adjacent end of the package for supporting the package.

10. The combined product and package of claim 2 wherein the joining flanges are substantially aligned at right angles relative to the planar portions of their associated package halves.

11. The combined product and package of claim 1 wherein said package halves are formed of a semi-rigid transparent plastic material.

12. The combined product and package of claim 1 wherein said plastic material is polyvinylchloride.

13. The combined product and package of claim 5 wherein the recesses in said package halves cooperatively define a U-shaped cord receiving passageway.

14. The combined product and package of claim 1 wherein said cord receiving pocket is a substantially box-shaped pocket.

15. The combined product and package of claim 1 wherein the electrical cord has a helical wound cord portion.

16. The combined product and package of claim 1 wherein the cord containing pocket further includes an information sheet containing instructions regarding the use and care of said product.

17. The combined product and package of claim 1 wherein said display sheet is opaque.

18. The combined product and package of claim 16 wherein both major surfaces of said sheet contains graphic and/or printed matter.

19. The combined product and package of claim 1 wherein at least one of said package halves is further provided with an elongated channel-shaped recess integrally joined to and projecting from said planar portion and positioned between said product and cord containing pocket for receiving and displaying the portion of the electrical cord extending from the product.

* * * * *

UNITED STATES PATENT AND TRADEMARK OFFICE

CERTIFICATE OF CORRECTION

PATENT NO. : 4,669,610

DATED : June 2, 1987

INVENTOR(S) : Frank Lindsey, Charles Walkley

It is certified that error appears in the above-identified patent and that said Letters Patent is hereby corrected as shown below:

IN THE CLAIMS

Column 5, Claim 2, line 44, before "package" insert --combined product and--.
line 45, delete "combined product and".

Claim 3, line 54, change "4" to --2--.

Claim 4, line 56, change "4" to --2--.

Claim 5, line 58, change "4" to --2--.

Column 6, Claim 8, line 19, before "rests" insert --and--.

Claim 13, line 38, change "5" to --6--.

Signed and Sealed this

Twelfth Day of January, 1988

*Attest:*

*Attesting Officer*

DONALD J. QUIGG

*Commissioner of Patents and Trademarks*